US009354572B2

(12) United States Patent
Yoshiura et al.

(10) Patent No.: US 9,354,572 B2
(45) Date of Patent: May 31, 2016

(54) FIXING DEVICE AND IMAGE FORMING APPARATUS

(71) Applicants: Arinobu Yoshiura, Kanagawa (JP); Hideo Nagafuji, Kanagawa (JP); Yuji Arai, Kanagawa (JP); Yutaka Ikebuchi, Kanagawa (JP); Kohichi Utsunomiya, Kanagawa (JP); Motoyoshi Yamano, Kanagawa (JP); Kiho Sai, Kanagawa (JP); Shohei Saito, Kanagawa (JP)

(72) Inventors: Arinobu Yoshiura, Kanagawa (JP); Hideo Nagafuji, Kanagawa (JP); Yuji Arai, Kanagawa (JP); Yutaka Ikebuchi, Kanagawa (JP); Kohichi Utsunomiya, Kanagawa (JP); Motoyoshi Yamano, Kanagawa (JP); Kiho Sai, Kanagawa (JP); Shohei Saito, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/836,129

(22) Filed: Aug. 26, 2015

(65) Prior Publication Data

US 2016/0062286 A1 Mar. 3, 2016

(30) Foreign Application Priority Data

Sep. 3, 2014 (JP) ..... 2014-179147

(51) Int. Cl.
*G03G 15/00* (2006.01)
*G03G 15/20* (2006.01)

(52) U.S. Cl.
CPC ..... *G03G 15/2057* (2013.01)

(58) Field of Classification Search
CPC ..... G03G 15/2053; G03G 15/2064; G03G 15/2039; G03G 15/2042; G03G 15/2017; G03G 15/2057; G03G 2215/2035
USPC ..... 399/329, 330, 334
See application file for complete search history.

(56) References Cited

U.S. PATENT DOCUMENTS 6,456,819 B1 * 9/2002 Abe ..... G03G 15/2064 219/216
7,428,401 B2 9/2008 Oonishi
(Continued)

FOREIGN PATENT DOCUMENTS

| | | |
|---|---|---|
| EP | 2 921 911 A1 | 9/2015 |
| JP | 2861280 | 12/1998 |
| JP | 2004-286922 | 10/2004 |
| JP | 2007-334205 | 12/2007 |
| JP | 2014-048487 A | 3/2014 |

OTHER PUBLICATIONS

U.S. Appl. No. 14/657,656, filed Mar. 13, 2015.
(Continued)

*Primary Examiner* — Walter L Lindsay, Jr.
*Assistant Examiner* — Jessica L Eley
(74) *Attorney, Agent, or Firm* — Oblon, McClelland, Maier & Neustadt, L.L.P.

(57) ABSTRACT

A fixing device includes: a rotatable endless belt type fixing member; a pressurizing member that is opposed to the fixing member and rotates; and a nip forming member that is arranged inside the fixing member, and forms a nip part by contact with the pressurizing member through the fixing member. The nip forming member includes: a heat-uniformizing member having bent portions opposed to each other; a heat-insulating member arranged inside the heat-uniformizing member; a heat-absorbing member arranged on an upper surface of the heat-insulating member; and a sliding sheet that covers a nip side of the heat-uniformizing member, and is held between the bent portions of the heat-uniformizing member and the heat-insulating member. The heat-uniformizing member and the heat-insulating member are fastened to each other by fitting a fitting part formed on the heat-uniformizing member to a fitted part formed on the heat-insulating member.

4 Claims, 10 Drawing Sheets

(56) References Cited

U.S. PATENT DOCUMENTS

| | | | | |
|---|---|---|---|---|
| 8,010,028 | B2 | 8/2011 | Shinshi | |
| 8,592,726 | B2 * | 11/2013 | Tsuruya | G03G 15/2042 219/216 |
| 2010/0232844 | A1 * | 9/2010 | Saito | G03G 15/1605 399/307 |
| 2011/0026987 | A1 * | 2/2011 | Hasegawa | G03G 15/2042 399/327 |
| 2011/0076071 | A1 | 3/2011 | Yamaguchi et al. | |
| 2014/0153983 | A1 | 6/2014 | Fujii et al. | |

OTHER PUBLICATIONS

U.S. Appl. No. 14/644,903, filed Mar. 11, 2015.
U.S. Appl. No. 14/793,949, filed Jul. 8, 2015.
U.S. Appl. No. 14/790,297, filed Jul. 2, 2015.
Office Action issued Jan. 28, 2016 in European Patent Application No. 15 181 259.1.

* cited by examiner

FIXING DEVICE AND IMAGE FORMING APPARATUS

CROSS-REFERENCE TO RELATED APPLICATIONS

The present application claims priority to and incorporates by reference the entire contents of Japanese Patent Application No. 2014-179147 filed in Japan on Sep. 3, 2014.

BACKGROUND OF THE INVENTION

1. Field of the Invention

The present invention relates to a heating type fixing device installed in an electrophotographic image forming apparatus and an image forming apparatus such as a copier, a printer, or a facsimile machine including this fixing device.

2. Description of the Related Art

In an image forming apparatus such as a copier, a printer, or a facsimile machine, an image is formed by an image forming process such as electrophotographic recording, electrostatic recording, or magnetic recording. Then, an unfixed toner image is formed on a recording medium, such as a recording medium sheet, printing paper, sensitized paper, or electrostatic recording paper, by an image transfer method or a direct method. As fixing devices for fixing an unfixed toner image, contact heating type fixing devices, such as a heat roller type, a film heating type, and an electromagnetic induction heating type, are widely adopted.

As examples of such fixing devices, a belt type fixing device (for example, see Japanese Laid-open Patent Publication No. 2004-286922) and a SURF fixing (film fixing) type of fixing device using a ceramic heater (for example, see Japanese Patent No. 2861280) are known.

As for the belt type fixing device, recently, it is hoped to further shorten the time required to reach a printable predetermined temperature (a reload temperature) from an ordinary temperature state, such as a state when the device is powered on. Furthermore, it is also hoped to shorten the time (the first print time) to perform a printing operation after preparation for printing and completing paper ejection since receipt of a request for the printing operation (Issue 1).

Furthermore, with speed improvement of image forming apparatus, the number of sheets passed through the apparatus per unit time is increased, and the quantity of heat required is increased. A lack of the heat quantity, which is called a temperature drop, especially at the beginning of continuous printing is a problem (Issue 2).

To resolve these Issues 1 and 2, there is known a fixing device configured to directly apply heat to a whole low-heat-capacity fixing belt thereby improving the heat-transfer efficiency significantly. This fixing device further shortens the warm-up time and the first print time and solves the lack of heat quantity at the time of continuous printing, thereby being able to achieve good fixing performance even if installed in a high-productive image forming apparatus.

Incidentally, a fixing device is based on the premise that various types of recording media pass through the device; for example, a recording medium having a width smaller than the heat-generating width of a fixing member (a fixing belt) in a longitudinal direction may pass through the device. In this case, a non-sheet passing area of the fixing member does not lose heat by the recording medium, and therefore has an excess quantity of heat and has an increase in temperature. Consequently, there is a problem that deterioration of the fixing member advances, resulting in life shortening (Issue 3).

There is a need to provide a fixing device capable of fastening a sliding sheet to a heat-uniformizing member with a simple configuration without impairing the fixing performance, durability, and conveying performance.

SUMMARY OF THE INVENTION

It is an object of the present invention to at least partially solve the problems in the conventional technology.

A fixing device includes: a rotatable endless belt type fixing member; a pressurizing member that is opposed to the fixing member and rotates; and a nip forming member that is arranged inside the fixing member, and forms a nip part by contact with the pressurizing member through the fixing member. The nip forming member includes: a heat-uniformizing member having bent portions opposed to each other; a heat-insulating member arranged inside the heat-uniformizing member; a heat-absorbing member arranged on an upper surface of the heat-insulating member; and a sliding sheet that covers a nip side of the heat-uniformizing member, and is held between the bent portions of the heat-uniformizing member and the heat-insulating member. The heat-uniformizing member and the heat-insulating member are fastened to each other by fitting a fitting part formed on the heat-uniformizing member to a fitted part formed on the heat-insulating member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Before explaining an embodiment, we explain preliminary matters for facilitating the understanding of the embodiment below.

To resolve the above-described Issue 3, there is proposed a technique to replace a part of a nip forming member forming a fixing nip with highly heat-conductive material and absorb heat of a non-sheet passing area, thereby suppressing an increase in temperature. This technique does not require a member for blocking heat supply to the non-sheet passing area and a mechanism for driving the member or an air-cooling fan mechanism, and enables the suppression of an increase in temperature of the non-sheet passing area with a simple configuration.

Meanwhile, the nip forming member has direct contact with and slides on a fixing belt, and therefore the durability of the fixing belt may deteriorate. To cope with this, there is proposed a fixing device in which the nip side of a nip forming member is covered with a sliding sheet made of material with low friction property so that the durability of a fixing belt can be improved.

Figure 1:
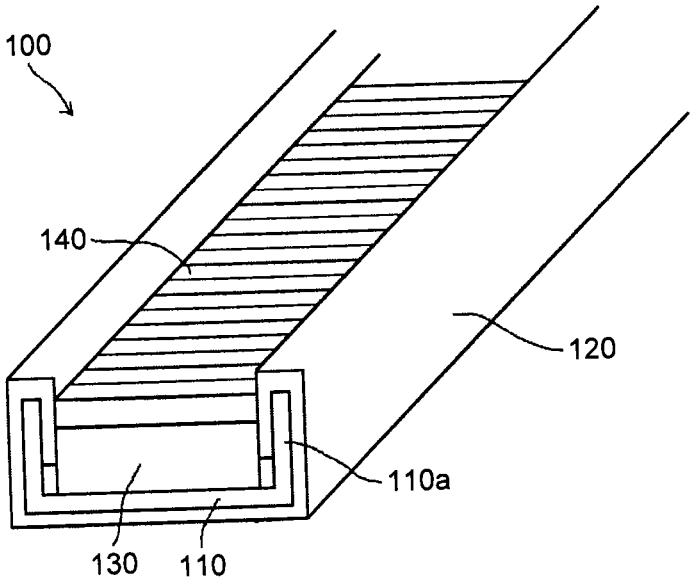
FIG. 1 is a perspective view showing an example of a nip forming member.

FIG. 1 is a perspective view showing an example of the nip forming member. As shown in FIG. 1, a nip forming member 100 includes a heat-uniformizing member 110, a sliding sheet 120 with which a nip-part surface of the heat-uniformizing member 110 is covered, and a heat-conductive member (a heat-insulating member 130 and a heat-absorbing member 140). Specifically, the nip forming member 100 is placed on the upstream side of a fixing nip; the sliding sheet 120 is penetrated by a sharp tip of a bent portion 110*a*, and is held and fastened by the heat-uniformizing member 110 and the heat-insulating member 130.

In the nip forming member 100 configured in this way, an increase in temperature of a non-sheet passing area can be suppressed by the heat-conductive member absorbing heat of the non-sheet passing area. Furthermore, a friction load on a fixing belt when rotating is reduced by the sliding sheet 120; therefore, the durability of the fixing belt can be improved.

However, such a configuration of the nip forming member 100 in which the sliding sheet 120 is held and fastened between the heat-uniformizing member 110 and the heat-insulating member 130 makes the installation unstable, such as that the heat-insulating member 130 is lifted up by a restoring force of a bent portion of the sliding sheet 120. In this case, the effect of suppressing an increase in temperature of the non-sheet passing area is insufficient, and the fixing performance is impaired.

To fasten the heat-insulating member 130 to the heat-uniformizing member 110, if a screw hole is made in the heat-uniformizing member 110 and the heat-insulating member 130 is screwed and fastened to the heat-uniformizing member 110, there is a need to make the heat-uniformizing member 110 thick to ensure a screw thread, which causes an increase in cost and a restriction on a layout. To the contrary, if a screw hole is made in the heat-insulating member 130, the heat-uniformizing member 110 is screwed and fastened to the heat-insulating member 130 after the sliding sheet 120 has been held between the heat-uniformizing member 110 and the heat-insulating member 130; therefore, there is a need to make a hole for thread fastening in the nip side of the sliding sheet 120. The sliding sheet 120 may be torn starting from the hole, and this may result in an increase in the friction load on the fixing belt and a decrease in the durability.

Furthermore, a direction of holding the sliding sheet 120 (the nip back side) does not agree with a direction of tightening a screw (the nip side); therefore, after the sliding sheet 120 has been held between the heat-uniformizing member 110 and the heat-insulating member 130, the sliding sheet 120 needs to be turned inside out to tighten the screw, so there is a problem that the assembling efficiency is poor.

In the following embodiment, there is described a fixing device capable of fastening a sliding sheet to a heat-uniformizing member with a simple configuration without impairing the fixing performance, durability, and conveying performance.

An embodiment of the present invention is explained below.

Figure 2:
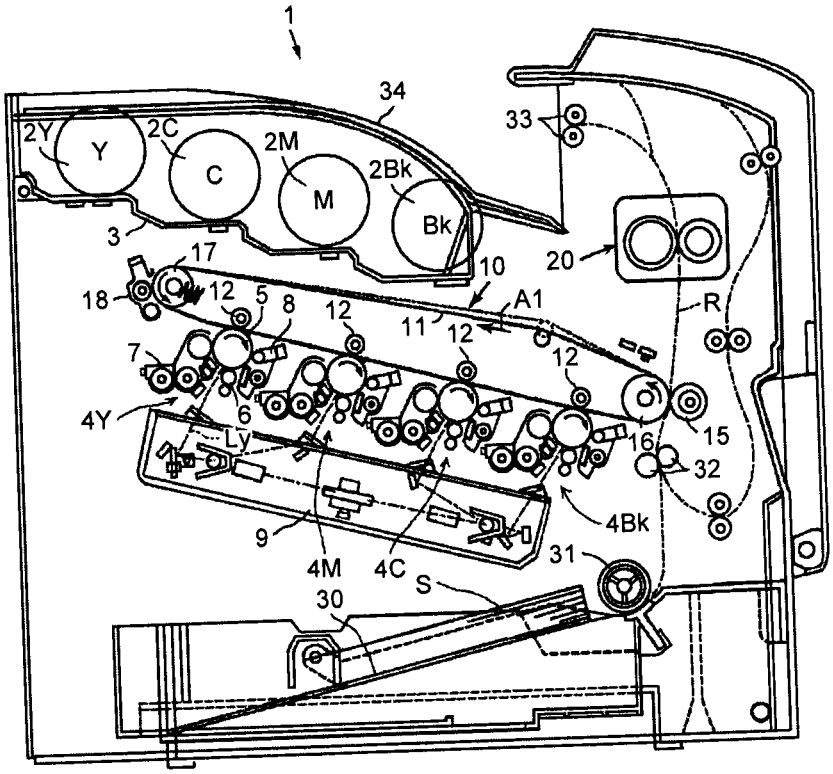
FIG. 2 is a schematic diagram showing a cross-section of a color printer which is an embodiment of an image forming apparatus.

FIG. 2 is a schematic diagram showing a cross-section of a color printer which is an embodiment of an image forming apparatus. As shown in FIG. 2, four image forming units 4Y, 4M, 4C, and 4Bk are installed in the center of an image forming apparatus 1. The image forming units 4Y, 4M, 4C, and 4Bk have the same configuration, except that they contain yellow (Y), magenta (M), cyan (C), and black (Bk) developers corresponding to color separation components of a color image, respectively.

The image forming units 4Y, 4M, 4C, and 4Bk each include a drum-shaped photoconductor 5 as a latent image bearer, a charging device 6 for charging the surface of the photoconductor 5, a developing device 7 for supplying toner to the surface of the photoconductor 5, a cleaning device 8 for cleaning the surface of the photoconductor 5, etc. Incidentally, in FIG. 2, only the photoconductor 5, the charging device 6, the developing device 7, and the cleaning device 8 that the yellow-image forming unit 4Y includes are assigned reference numerals, and reference numerals of those included in the other image forming units 4M, 4C, and 4Bk are omitted.

Below the image forming units 4Y, 4M, 4C, and 4Bk, an exposure device 9 for exposing the surface of each photoconductor 5 to light is placed. The exposure device 9 includes a semiconductor laser as a light source, a coupling lens, an f-θ lens, a toroidal lens, a reflecting mirror, a rotating polygon mirror as a deflecting means, etc. The exposure device 9 emits a writing light corresponding to each color to each photoconductor 5 (for example, a writing light Ly to the photoconductor 5), thereby forming an electrostatic latent image on the photoconductor 5.

Above the image forming units 4Y, 4M, 4C, and 4Bk, a transfer belt unit 10 is arranged. The transfer belt unit 10 includes a transfer belt 11 as a transfer body, primary transfer rollers 12 as primary transfer means, a secondary transfer roller 15 as a secondary transfer means, a drive roller 16, a driven roller 17, and a belt cleaning device 18.

The transfer belt 11 is an endless belt, and is held taut by the drive roller 16 and the driven roller 17. Here, the drive roller 16 is driven to rotate, thereby the transfer belt 11 moves around (rotates) in a direction of an arrow A1 shown in FIG. 2.

The primary transfer rollers 12 nip the transfer belt 11 with the photoconductors 5 and form primary transfer nips therebetween, respectively. Furthermore, a power source (not shown) is connected to each primary transfer roller 12, and a predetermined direct-current (DC) voltage and/or alternating-current (AC) voltage is applied to the primary transfer roller 12.

The secondary transfer roller 15 nips the transfer belt 11 with the drive roller 16 and forms a secondary transfer nip therebetween. Furthermore, just like the primary transfer rollers 12, a power source (not shown) is connected to the secondary transfer roller 15 as well, and a predetermined direct-current (DC) voltage and/or alternating-current (AC) voltage is applied to the secondary transfer roller 15.

The belt cleaning device 18 includes a cleaning brush and a cleaning blade which are arranged to be opposed to and in abutting contact with the transfer belt 11. The cleaning brush and the cleaning blade clean the transfer belt 11 by scraping off and removing foreign substances such as residual toner on the transfer belt 11. Furthermore, the belt cleaning device 18 includes an eliminating means (not shown) for carrying and discarding the residual toner removed from the transfer belt 11.

In the upper part of the image forming apparatus 1, a bottle container 3 is placed. Toner bottles 2Y, 2C, 2M, and 2Bk, which each contain toner for replenishment, are removably attached to the bottle container 3. Supply lines (not shown) are installed in between the toner bottles 2Y, 2C, 2M, 2Bk and the developing devices 7, respectively; each developing device 7 is replenished with toner from a corresponding toner bottle 2 through the supply line.

In the lower part of the image forming apparatus 1, a paper feed tray 30 containing sheets S as recording media, a paper feed roller 31 for carrying a sheet S out of the paper feed tray 30, etc. are placed. The recording media here include plain paper as well as heavy paper, postcards, envelopes, thin paper, coated paper (coat paper, art paper, etc.), tracing paper, viewgraphs, etc. Furthermore, although not shown, a manual paper feeding mechanism can be provided.

Inside the image forming apparatus 1, there is disposed a conveyance path R through which a sheet S conveyed from the paper feed tray 30 passes through the secondary transfer nip and is ejected out of the apparatus. On the conveyance path R, a pair of registration rollers 32 as a conveying means for conveying a sheet S to the secondary transfer nip is arranged on the upstream side of the secondary transfer roller 15 in a sheet conveying direction.

Furthermore, a fixing device 20 for fixing an unfixed image transferred onto a sheet S is arranged on the downstream side of the secondary transfer roller 15 in the sheet conveying direction. Moreover, a pair of paper ejection rollers 33 for ejecting a sheet out of the apparatus is arranged on the conveyance path R on the downstream side of the fixing device 20 in the sheet conveying direction. Furthermore, on a top surface of the printer body, a copy receiving tray 34 on which sheets ejected out of the apparatus are stocked is arranged.

Subsequently, an image forming operation is explained with reference to FIG. 2. First, the photoconductors 5 each are driven to rotate clockwise by a drive device (not shown), and the surfaces of the photoconductors 5 each are uniformly charged to given polarity by the charging devices 6, respectively. The charged surfaces of the photoconductors 5 are irradiated with laser lights from the exposure device 9, and electrostatic latent images are formed on the surfaces of the photoconductors 5, respectively. Image information that the photoconductors 5 are exposed to the laser lights corresponding thereto is image information of a single-color image into which a desired full-color image is broken down by yellow (Y), cyan (C), magenta (M), and black (Bk) toner color information. Then, the electrostatic latent images formed on the photoconductors 5 are developed (visualized) into toner images by being supplied with color toners (developers) by the developing devices 7, respectively.

While the transfer belt 11 is moving around (rotating) in the direction of the arrow A1, a primary transfer voltage with polarity opposite to the toner charge polarity is applied to each of the primary transfer rollers 12. Accordingly, a transfer electric field is formed on the primary transfer nip formed between each primary transfer roller 12 and each photoconductor 5. Then, when the toner images on the photoconductors 5 have come to the primary transfer nips in accordance with the rotation of the photoconductors 5, the toner images on the photoconductors 5 are sequentially transferred onto the transfer belt 11 by the transfer electric fields in a manner superimposed on top of another. In this way, a full-color toner image is borne on the surface of the transfer belt 11. Residual toner, which was unable to be transferred onto the transfer belt 11, on each photoconductor 5 is removed by each cleaning device 8. After that, residual electric charge on the surface of each photoconductor 5 is eliminated by a charge neutralizer (not shown), and the surface potential is initialized.

In the lower part of the image forming apparatus 1, the paper feed roller 31 is driven and starts rotating, and a sheet S is fed from the paper feed tray 30 into the conveyance path R with the rotation of the paper feed roller 31. The sheet S fed into the conveyance path R is conveyed to the secondary transfer nip formed between the secondary transfer roller 15 and the drive roller 16 with proper timing by the registration rollers 32. At this time, a transfer voltage with polarity opposite to the toner charge polarity of the toner image on the transfer belt 11 is applied to the secondary transfer roller 15, thereby a transfer electric field is formed on the secondary transfer nip.

Then, when the toner image on the transfer belt 11 has come to the secondary transfer nip in accordance with the movement of the transfer belt 11, the toner image on the transfer belt 11 is collectively transferred onto the sheet S by the transfer electric field formed on the secondary transfer nip. Incidentally, residual toners, which were unable to be transferred onto the sheet S, on the transfer belt 11 are removed by the belt cleaning device 18. The removed toners is conveyed to and collected in a waste toner container (not shown).

Then, the sheet S is conveyed to the fixing device 20, and the toner image on the sheet S is fixed on the sheet S by the fixing device 20. Then, the sheet S is ejected out of the apparatus by the paper ejection rollers 33, and is stocked on the copy receiving tray 34.

There is described above the image forming operation of when a full-color image is formed on a sheet; however, a single-color image can be formed by using any one of the four image forming units 4Y, 4M, 4C, and 4Bk, or a two or three-color image can be formed by using two or three image forming units.

Figure 3:
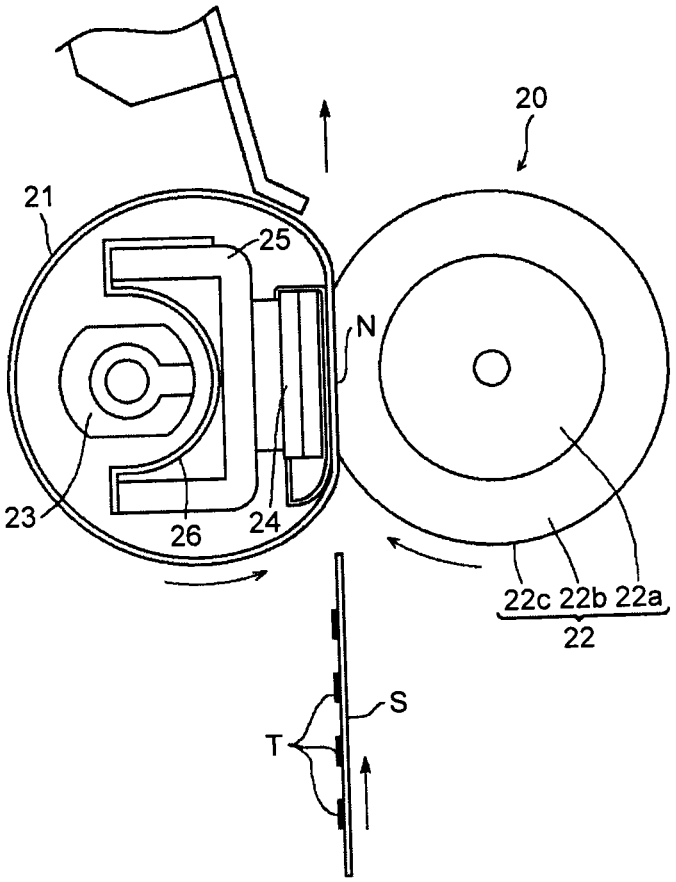
FIG. 3 is a schematic configuration diagram of a fixing device installed in the image forming apparatus.

FIG. 3 is a schematic configuration diagram of the fixing device installed in the image forming apparatus. As shown in FIG. 3, the fixing device 20 includes a fixing belt 21 as a rotatable endless belt type fixing member, a pressure roller 22 as a pressurizing member rotatably mounted to be opposed to the fixing belt 21, and a halogen heater 23 as a heat source for heating the fixing belt 21. Furthermore, the fixing device 20 includes a nip forming member 24 arranged inside the fixing belt 21, a stay 25 as a supporting member for supporting the nip forming member 24, and a reflecting member 26 for reflecting a light radiating from the halogen heater 23 onto the fixing belt 21.

The fixing belt 21 is composed of a thin-wall, flexible endless belt member (including film). For details, the fixing belt 21 is composed of an inner peripheral base material formed of metallic material, such as nickel (Ni) or stainless steel (SUS), or base material, such as polyimide (PI), and an outer peripheral release layer formed of such as PFA or PTFE. Furthermore, an elastic layer formed of rubber material, such as silicone rubber, foamable silicone rubber, or fluororubber, can lie between the base material and the release layer.

The pressure roller 22 is composed of a cored bar 22*a*, an elastic layer 22*b* made of such as foamable silicone rubber, silicone rubber, or fluororubber provided on the surface of the cored bar 22*a*, and a release layer 22*c* made of such as PFA or PTFE provided on the surface of the elastic layer 22*b*. The pressure roller 22 is pressurized to the side of the fixing belt 21 by a pressurizing means (not shown) and brought into contact with the nip forming member 24 through the fixing belt 21. At a point at which this pressure roller 22 is pressed against the fixing belt 21, the elastic layer 22*b* of the pressure roller 22 is crushed, thereby a nip part N with a predetermined width is formed.

Furthermore, the pressure roller 22 is configured to be driven to rotate by a drive source such as a motor (not shown) installed in the image forming apparatus. When the pressure roller 22 is driven to rotate, its driving force is transmitted to the fixing belt 21 at the nip part N, and the fixing belt 21 is driven to rotate.

In the present embodiment, the pressure roller 22 is a solid roller; however, the pressure roller 22 can be a hollow roller. In this case, a heat source such as a halogen heater can be arranged inside the pressure roller 22. Furthermore, if there is no elastic layer provided, the heat capacity is reduced, and the fixing performance is improved; however, microasperities on the belt surface may be transferred onto an image when the image is fixed on a sheet by squashing unfixed toner, and a solid part of the image may have uneven brightness. To prevent this, it is preferable to provide an elastic layer with a thickness of 100 μm or more. By providing an elastic layer with a thickness of 100 μm or more, the microasperities can be absorbed by elastic deformation of the elastic layer, and therefore it is possible to avoid the occurrence of uneven brightness.

The elastic layer 22*b* can be solid rubber; however, sponge rubber can also be used if there is no heat source inside the pressure roller 22. Sponge rubber is more preferable because the heat insulating property is enhanced, and heat of the fixing belt 21 is less likely to be taken. Furthermore, a fixing rotating body and its opposed rotating body are not limited to be pressed against each other; alternatively, they can be configured to be just in contact with each other instead of pressing against each other.

Both end parts of each halogen heater 23 are secured to side plates (not shown) of the fixing device 20. The halogen heater 23 is configured to be controlled to output and generate heat by a power source unit installed in the image forming apparatus. Furthermore, besides a halogen heater, for example, an IH heater, a resistance heating element, or a carbon heater can be used as a heat source for heating the fixing belt 21.

The nip forming member 24 is longitudinally arranged along an axial direction of the fixing belt 21 or an axial direction of the pressure roller 22, and is fixed and supported by the stay 25. This prevents the occurrence of bending of the nip forming member 24 due to pressure from the pressure roller 22, and uniform nip width along the axial direction of the pressure roller 22 is obtained. Details of the nip forming member 24 will be described later.

The reflecting member 26 is arranged between the stay 25 and the halogen heater 23. In the present embodiment, the reflecting member 26 is fixed to the stay 25. Furthermore, the reflecting member 26 is directly heated by the halogen heater 23; therefore, it is preferable that the reflecting member 26 is formed of high-melting-point metallic material or the like. As the reflecting member 26 is arranged in this way, a light radiating from the halogen heater 23 to the side of the stay 25 is reflected onto the fixing belt 21. This can increase the quantity of light emitted to the fixing belt 21, and therefore can heat the fixing belt 21 efficiently. Furthermore, it is possible to suppress radiant heat from the halogen heater 23 from being transmitted to the stay 25 etc., and therefore it is also possible to conserve energy.

The fixing device according to the present embodiment is configured to directly heat an endless belt, and therefore can improve the heat-transfer efficiency significantly. Consequently, the fixing device can further shorten the warm-up time and the first print time and solve a lack of heat quantity at the time of continuous printing, and therefore can achieve good fixing performance even if installed in a high-productive image forming apparatus.

Figure 4:
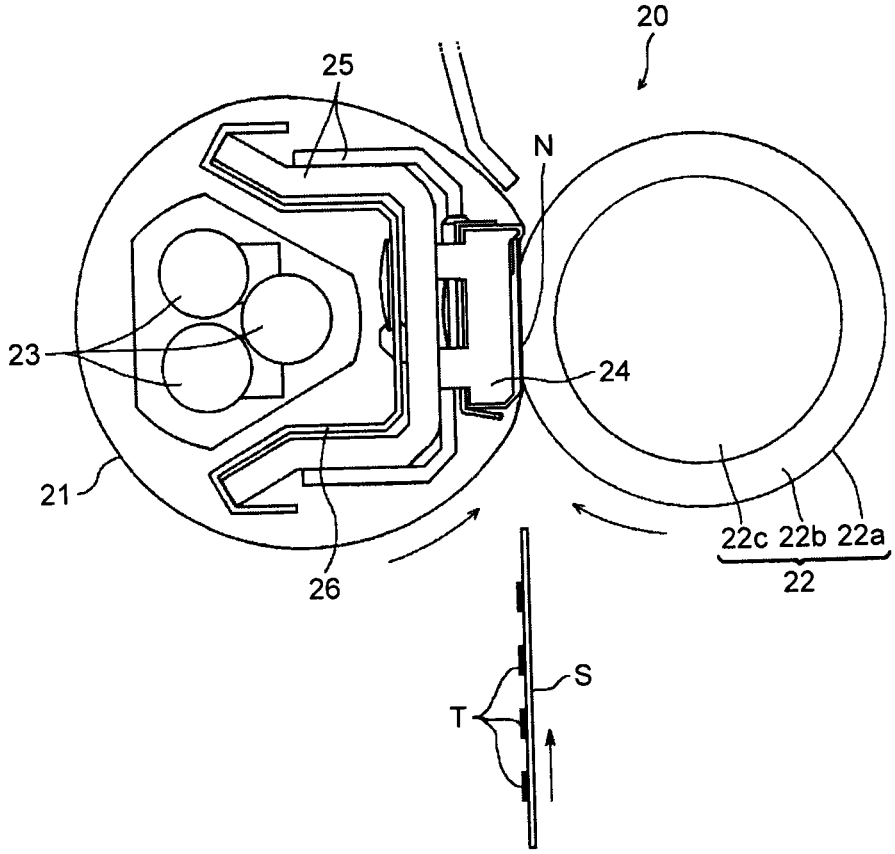
FIG. 4 is a schematic configuration diagram showing another form of a fixing device installed in the image forming apparatus.

FIG. 4 is a schematic configuration diagram showing another form of a fixing device installed in the image forming apparatus. In FIG. 4, the same component as in FIG. 3 is assigned the same reference numeral, and detailed description of the component is omitted. As shown in FIG. 4, the present form of the fixing device 20 is composed of three halogen heaters to respond to different sheet widths. By providing heaters corresponding to the sheet widths, excess supply of heat can be suppressed, and energy conservation can be improved.

Incidentally, a fixing device is based on the premise that various types of recording media pass through the device; for example, a recording medium having a width smaller than the heat-generating width of a fixing member (a fixing belt) in a longitudinal direction may pass through the device. In this case, a non-sheet passing area of the fixing member does not lose heat by the recording medium, and therefore has an excess quantity of heat and has an increase in temperature. Consequently, there is a problem that deterioration of the fixing member advances, resulting in life shortening.

To cope with this, a part of a nip forming member forming a fixing nip is replaced with highly heat-conductive material, and the heat of the non-sheet passing area is absorbed, thereby the increase in temperature is suppressed. Furthermore, the nip forming member has direct contact with and slides on the fixing belt, and therefore the durability of the fixing belt may deteriorate. To cope with this, a sliding sheet made of material with low friction property is installed in the nip forming member.

Figure 5:
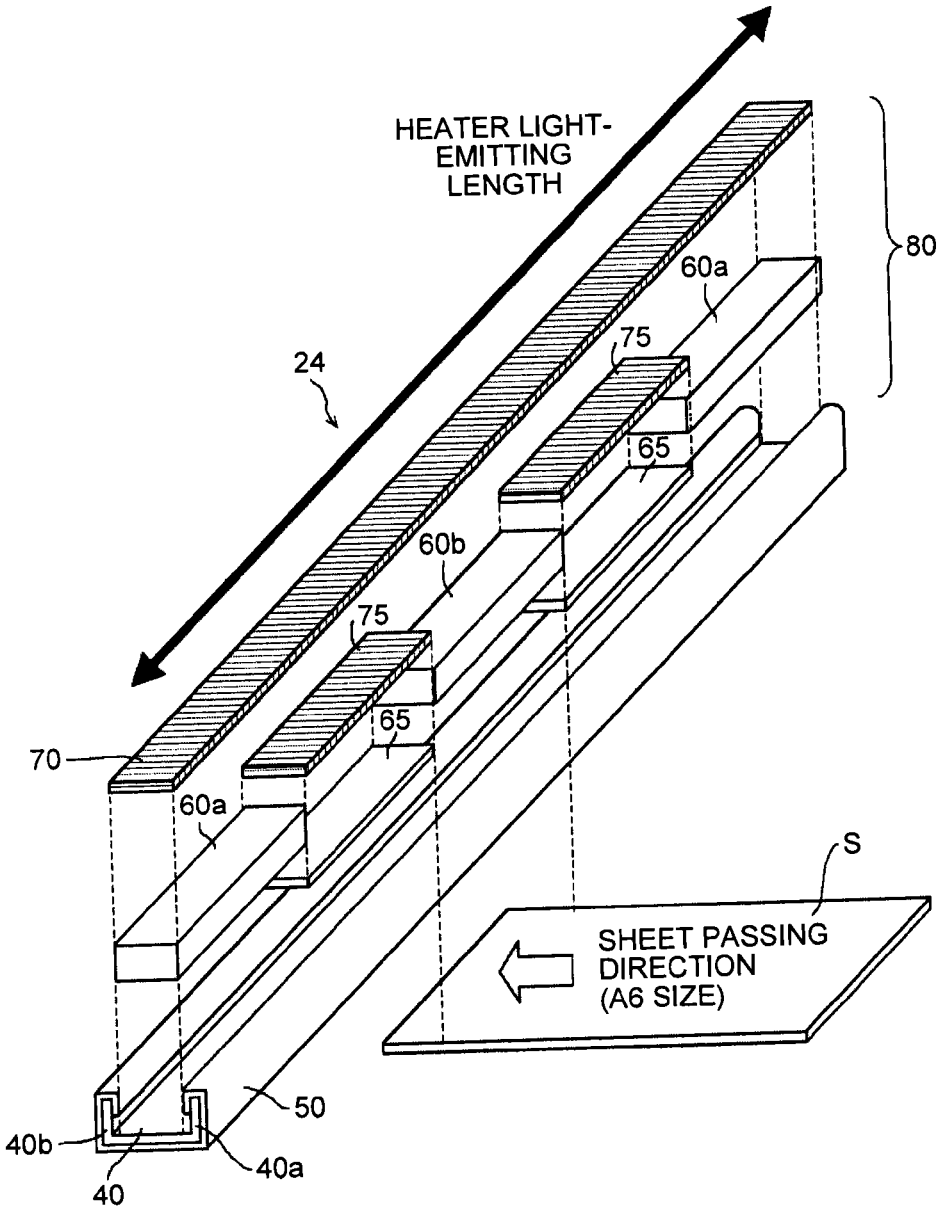
FIG. 5 is an exploded perspective view of a nip forming member according to the present embodiment.

FIG. 5 is an exploded perspective view of the nip forming member according to the present embodiment. As shown in FIG. 5, the nip forming member 24 includes a heat-uniformizing member 40, a sliding sheet 50 which covers a nip side of the heat-uniformizing member 40, first heat-insulating members 60*a* and 60*b*, a second heat-insulating member 65, a first heat-absorbing member 70, and a second heat-absorbing member 75.

The heat-uniformizing member 40 is made of highly heat-conductive material such as copper (Cu), and is arranged along a longitudinal direction of the fixing belt. The heat-uniformizing member 40 absorbs heat excessively accumulated in a non-sheet passing area of the fixing belt, and moves the heat in a longitudinal direction of the heat-uniformizing member 40. Accordingly, variation in a temperature distribution of the fixing belt can be reduced. Furthermore, the heat-uniformizing member 40 has bent portions 40*a* and 40*b* which are formed to be opposed to each other inside the fixing belt, and the tip of the bent portion 40*b* located on the upstream side of the fixing nip part has a sharp shape.

The sliding sheet 50, which covers the nip side of the heat-uniformizing member 40, is made of material with low friction property, and is preferably made of, for example, TOYOFLON™ manufactured by Toray Industries, Inc. The sliding sheet 50 is penetrated by the sharp tip of the bent portion 40*b* of the heat-uniformizing member 40, and is held and fastened by the bent portions 40*a* and 40*b* of the heat-uniformizing member 40, the first heat-insulating members 60*a* and 60*b*, and the second heat-insulating member 65.

A friction load on the fixing belt when rotating is reduced by the sliding sheet 50, and a driving torque on the fixing belt is reduced. When the fixing belt rotates, the sliding sheet 50 is pulled in a sliding direction; however, the sliding sheet 50 is securely held by the tip of the bent portion 40*b*. Incidentally, when the fixing belt rotates backward, it is effective that the tip of the bent portion 40*a* is also formed into a sharp shape.

Inside the heat-uniformizing member 40, the first heat-insulating members 60*a* and 60*b* and the second heat-insulating member 65 which are made of material having lower thermal conductivity than the heat-uniformizing member 40, for example, resin are arranged. The second heat-insulating member 65 is in a non-sheet passing area of the heat-uniformizing member 40 and in a location where the temperature increases. The first heat-insulating members 60*a* and 60*b* are located on both end parts and center part of the heat-uniformizing member 40 except the location of the second heat-insulating member 65.

The second heat-absorbing member 75 is arranged on the upper surface of the second heat-insulating member 65, and the first heat-absorbing member 70 is arranged on the upper surface of the first heat-insulating members 60*a* and 60*b* and the second heat-absorbing member 75. The first heat-absorbing member 70 and the second heat-absorbing member 75 are also made of highly heat-conductive material such as copper (Cu).

The first heat-absorbing member 70 and the second heat-absorbing member 75 absorb heat by promoting movement of heat in a thickness direction of the nip forming member 24. That is, the first heat-absorbing member 70 and the second heat-absorbing member 75 are for supplementing the heat capacity of the heat-uniformizing member 40; especially, it is preferable that the first heat-absorbing member 70 has a large heat capacity or the surface area of the first heat-absorbing member 70 is increased to enhance the heat dissipation. Furthermore, the second heat-absorbing member 75 adjusts the thickness or length according to the magnitude of the temperature increase of the non-sheet passing area.

On the other hand, the first heat-insulating members 60*a* and 60*b* prevent the first heat-absorbing member 70 from excessively absorbing heat from the fixing belt. Accordingly, it is possible to prevent a temperature drop of the fixing belt and also prevent poor fixing and increases in the warm-up time and power consumption. Furthermore, the second heat-insulating member 65 plays a role in adjusting the quantity of heat moving from the heat-uniformizing member 40 to the first heat-absorbing member 70 through the second heat-absorbing member 75. Therefore, in the same manner as the second heat-absorbing member 75, the second heat-insulating member 65 adjusts the thickness or length according to the magnitude of the temperature increase of the non-sheet passing area.

Hereinafter, a member composed of the first heat-insulating members 60*a* and 60*b*, the second heat-insulating member 65, the first heat-absorbing member 70, and the second heat-absorbing member 75 integrally is collectively referred to as a heat-conductive member 80. That is, the nip forming member 24 is composed of the heat-uniformizing member 40, the sliding sheet 50 included in the heat-uniformizing member 40, and the heat-conductive member 80.

Subsequently, a method of fastening the heat-uniformizing member and the heat-conductive member to each other, which is a feature of the present invention, is explained in detail.

Figure 6:
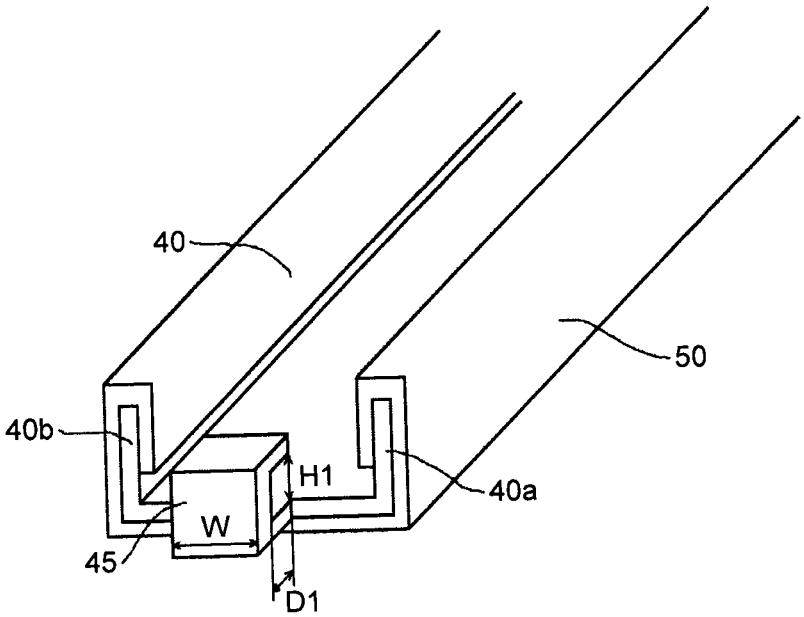
FIG. 6 is a perspective view showing an end part of a heat-uniformizing member according to the present embodiment.
Figure 7:
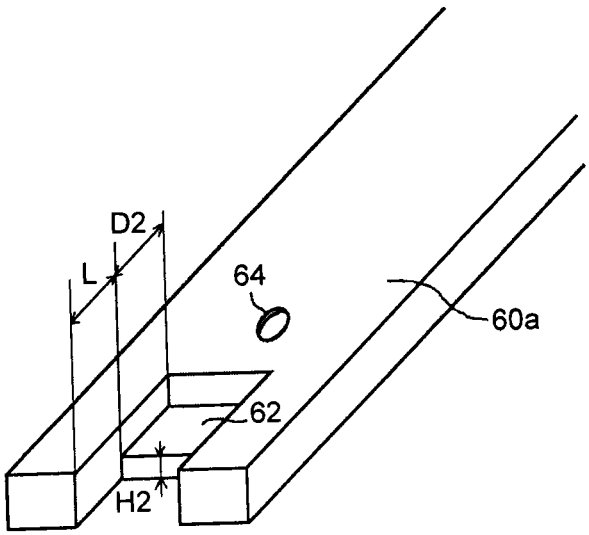
FIG. 7 is a perspective view showing an end part of a first heat-insulating member according to the present embodiment.
Figure 8:
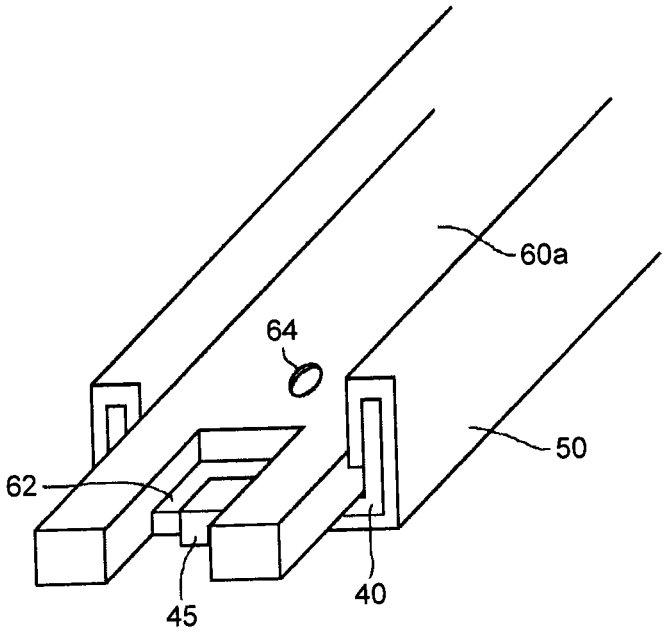
FIG. 8 is a perspective view showing a fitting state of the heat-uniformizing member and the first heat-insulating member.

FIG. 6 is a perspective view showing an end part of the heat-uniformizing member according to the present embodiment, and FIG. 7 is a perspective view showing an end part of the first heat-insulating member according to the present embodiment. FIG. 8 is a perspective view showing a fitting state of the heat-uniformizing member and the first heat-insulating member.

As shown in FIG. 6, on the end of the heat-uniformizing member 40, an L-shaped fitting part 45 made of the same material as the heat-uniformizing member 40 is formed roughly in the center between the bent portions 40*a* and 40*b* of the heat-uniformizing member 40. This fitting part 45 is also formed on the other end (not shown) of the heat-uniformizing member 40. Furthermore, the width of a fitting portion of the fitting part 45 is denoted by H1, the depth of the fitting part 45 is denoted by D1, and the width of the fitting part 45 is denoted by W.

Meanwhile, as shown in FIG. 7, one end of the first heat-insulating member 60*a* has a U-shape. A fitted part 62 is formed on an inner bottom surface of the U-shape, and a screw hole 64 is made in the bottom surface of the U-shape longitudinally. The height of the fitted part 62 is denoted by H2, the depth of the fitted part 62 is denoted by D2, and the length from an end surface of the fitted part 62 to an end surface of the first heat-insulating member 60*a* is denoted by L.

The width (H1) of the fitting part 45 of the heat-uniformizing member 40 has a little play or no play with respect to the height (H2) of the fitted part 62 of the first heat-insulating member 60*a*. Furthermore, the depth (D1) of the fitting part 45 is smaller than the depth (H2) of the fitted part 62. Accordingly, as shown in FIG. 8, the fitting part 45 and the fitted part 62 can be fitted, and a friction force is generated on the contact surface between the fitting part 45 and the fitted part 62, and therefore the heat-uniformizing member 40 and the first heat-insulating member 60*a* are fastened to each other. Incidentally, the width (W) of the fitting part can be set so that the heat-uniformizing member 40 and the first heat-insulating member 60*a* are properly fastened to each other.

Figure 9:
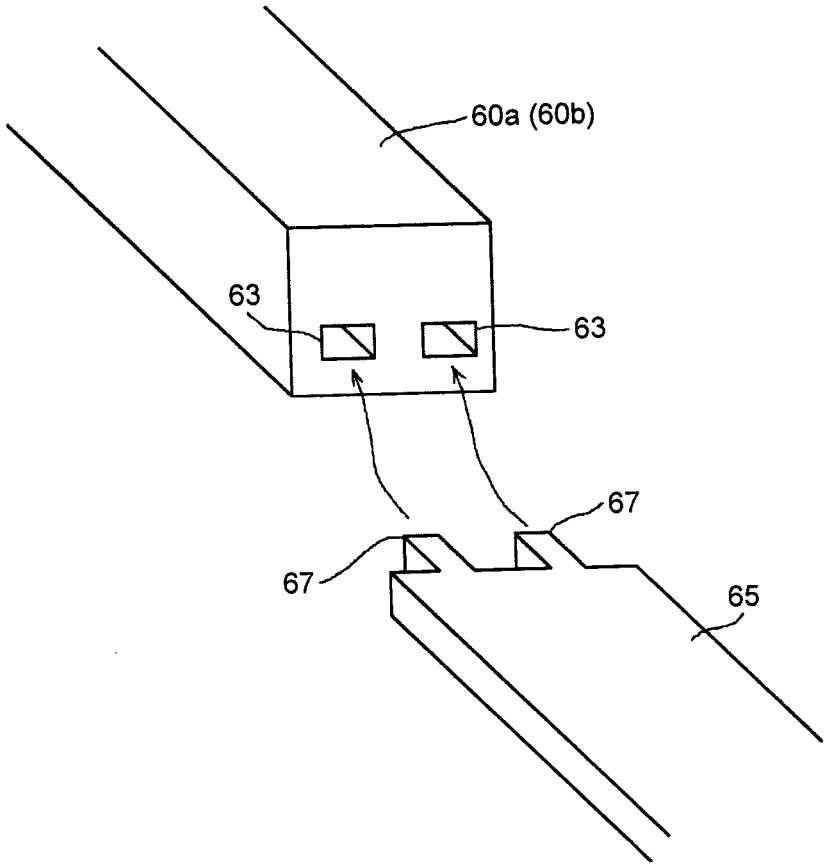
FIG. 9 is a perspective view showing a method of connecting the first heat-insulating members and a second heat-insulating member according to the present embodiment.

FIG. 9 is a perspective view showing a method of connecting the first heat-insulating members and the second heat-insulating member according to the present embodiment. As shown in FIG. 9, two dents 63 having a rectangular cross-section are formed on each of the first heat-insulating members 60*a* and 60*b*. On the other hand, two bumps 67 having a rectangular cross-section are formed on the end surface of the second heat-insulating member 65 in a longitudinal direction. The cross-sections of the dents 63 of the first heat-insulating members 60*a* and 60*b* have a little play or no play with respect to the cross-sections of the bumps 67 of the second heat-insulating member 65. Furthermore, the dents 63 and the bumps 67 are in a position relation in which the bumps 67 can be inserted into the dents 63; when the bumps 67 are inserted into the dents 63, the first heat-insulating members 60*a* and 60*b* and the second heat-insulating member 65 are connected in a state where there is no difference in level between three side surfaces.

Figure 10:
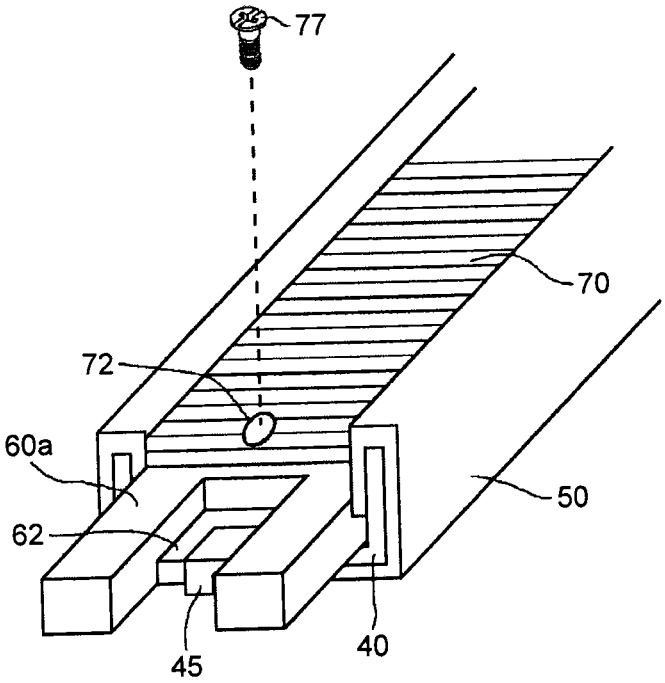
FIG. 10 is a perspective view showing a method of fastening a first heat-absorbing member according to the present embodiment.

FIG. 10 is a perspective view showing a method of fastening the first heat-absorbing member according to the present embodiment. As shown in FIG. 10, the first heat-absorbing member 70 has a through hole 72. On the other hand, the screw hole 64 is made in the first heat-insulating member 60*a*, so the first heat-absorbing member 70 and the first heat-insulating member 60*a* are fastened to each other by a screw 77 which is a fastening member. As described above, the first heat-insulating member 60*a* is fastened to the heat-uniformizing member 40; therefore, just by fastening the first heat-absorbing member 70 to the first heat-insulating member 60*a*, the first heat-absorbing member 70 can be fastened to the heat-uniformizing member 40. Accordingly, the number of thread fastening can be kept to the minimum; therefore, it is possible to improve the assembling workability and suppress an increase in cost.

Figure 11:
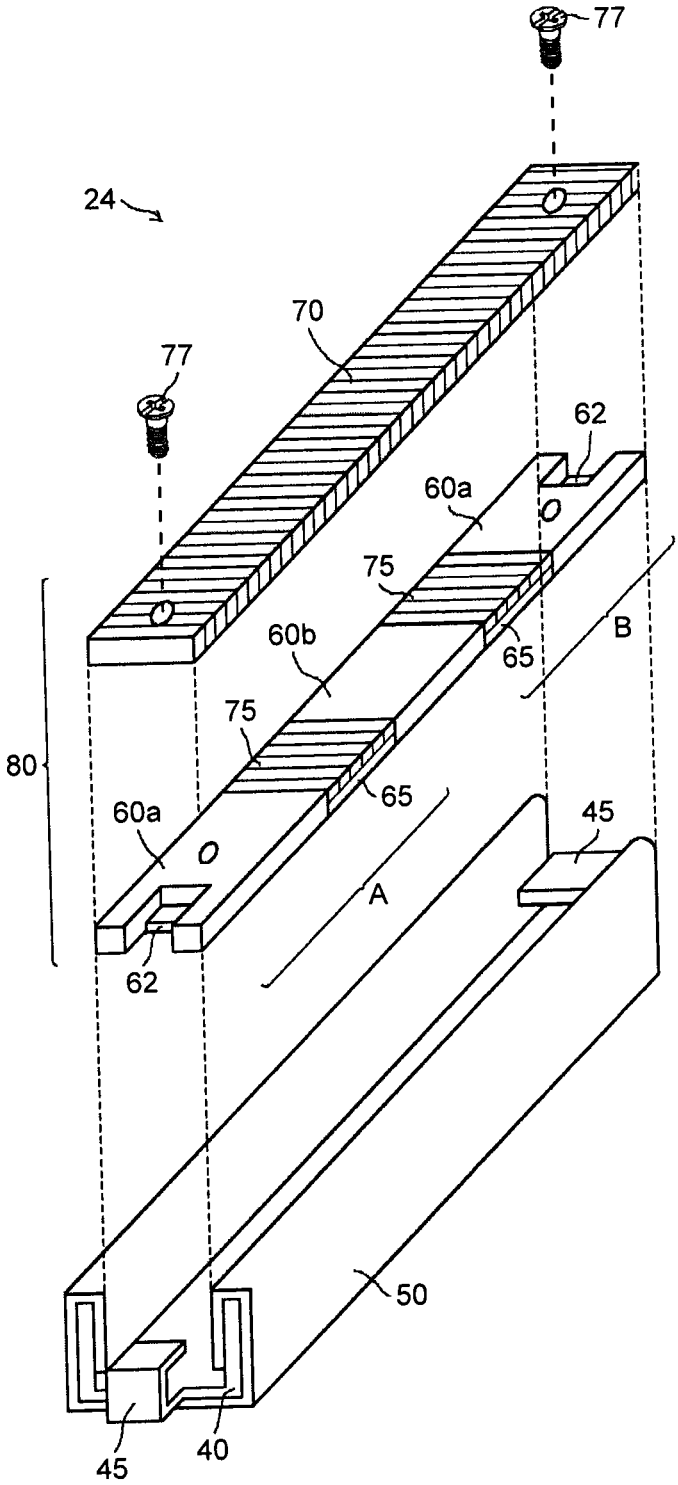
FIG. 11 is an exploded perspective view showing an assembling method of the nip forming member.

Subsequently, an example of an assembling method of the nip forming member is explained. FIG. 11 is an exploded perspective view showing the assembling method of the nip forming member. First, as shown in the lower part of FIG. 11, the sliding sheet 50 is installed in the heat-uniformizing member 40. Next, the first heat-insulating member 60*a* and the second heat-insulating member 65 indicated by A and B in the middle part of FIG. 11 are connected.

Next, the second heat-absorbing member 75 is arranged on top of each second heat-insulating member 65. Then, the second heat-insulating member 65 and the first heat-insulating member 60*b* indicated by A and B are connected so as to hold the second heat-absorbing member 75 between them. Then, the first heat-absorbing member 70 is fastened to the first heat-insulating member 60*a* by the screw 77, so that the heat-conductive member 80 is completed.

Next, the heat-conductive member 80 is fastened to the heat-uniformizing member 40. Both end parts (the first heat-insulating members 60*a*) of the heat-conductive member 80 are, as shown in FIG. 7, such that the end surface of the fitted part 62 is located behind the end surface of the first heat-insulating member 60*a* by the length L only. Therefore, when the fitted part 62 on one end of the heat-conductive member 80 is fitted into the fitting part 45 of the heat-uniformizing member 40, there is a clearance (a gap) of about a length 2L with respect to the fitting part 45 opposed to the fitted part 62 on the other end of the heat-conductive member 80. This clearance enables the whole conductive member 80 to fit in the heat-uniformizing member 40. When the fitted parts 62 on the both ends of the heat-conductive member 80 are fitted into the fitting parts 45 by translating the conductive member 80 in the longitudinal direction, the conductive member 80 and the heat-uniformizing member 40 are fastened to each other. As above, the nip forming member 24 is completed.

The completed nip forming member 24 is arranged along the axial direction of the fixing belt 21 or the axial direction of the pressure roller 22 as shown in FIG. 3 or 4, and is fixed and supported by the stay 25, so that the fixing device 20 according to the present embodiment is completed.

As explained above, in the fixing device according to the present embodiment, the fitting parts formed on the heat-uniformizing member and the fitted parts formed on the heat-insulating member are fitted, thereby the heat-uniformizing member and the heat-insulating member are fastened to each other. Therefore, the sliding sheet held between the heat-uniformizing member and the heat-insulating member can be securely fastened. Furthermore, thread fastening is not performed for the fastening of the heat-uniformizing member and the heat-insulating member; therefore, it is not necessary to change the layout, such as making the heat-uniformizing member thick to ensure a screw thread. Or, it is not necessary to make holes for thread fastening in the nip side of the sliding sheet and the heat-uniformizing member; therefore, the durability of the sliding sheet is not impaired, and the recording-medium conveying performance is not impaired.

Furthermore, the fixing device according to the present embodiment can suppress an increase in temperature by the nip forming member, which forms a fixing nip, absorbing heat of a non-sheet passing area. Therefore, it is possible to suppress the increase in temperature of the non-sheet passing area with a simple configuration, and possible to improve the fixing performance. Moreover, the nip forming member includes the sliding sheet made of material with low friction property; therefore, it is possible to improve the durability of the fixing belt.

(Variation)

The present invention is not limited to the above-described embodiment, and various modifications can be made within the scope of the invention.

Figure 12:
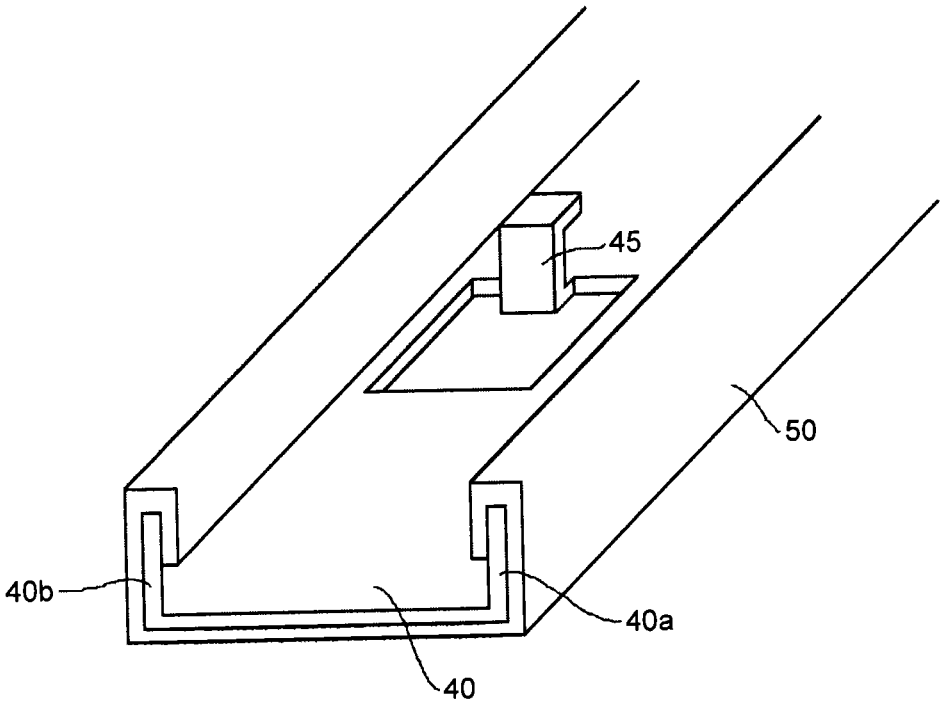
FIG. 12 is a diagram showing a variation of a fitting part provided on the heat-uniformizing member.
Figure 13:
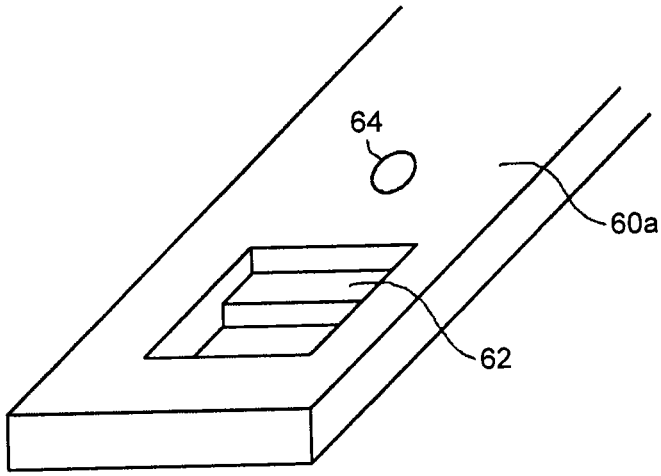
FIG. 13 is a diagram showing a variation of a fitted part provided on the first heat-insulating member.

FIG. 12 is a diagram showing a variation of the fitting part provided on the heat-uniformizing member, and FIG. 13 is a diagram showing a variation of the fitted part provided on the first heat-insulating member. A component in FIG. 12 identical to that in FIG. 6 or a component in FIG. 13 identical to that in FIG. 7 is assigned the same reference numeral, and detailed description of the component is omitted. First, as shown in FIG. 12, the fitting part 45 can be provided on a location other than both ends of the heat-uniformizing member 40. Furthermore, as shown in FIG. 13, the fitted part 62, which is fitted in the fitting part of the heat-uniformizing member, can be formed on a rectangular hole on the first heat-insulating member, as viewed in planar view. In this way, the fitting parts of the heat-uniformizing member 40 and the first heat-insulating member 60*a* are not limited to the end part of the heat-uniformizing member 40 or the end part of the first heat-insulating member 60*a*, and can be set according to specifications of the nip forming member.

As shown in FIG. 9, the first heat-insulating members 60*a* and 60*b* and the second heat-insulating member are connected by the two rectangular dents 63 and the two rectangular bumps 67. The cross-sections of the dents 63 and bumps 67 are not limited to be rectangular in shape, and can be formed into a circular shape or an elliptical shape. Furthermore, the number of the dents 63 and the bumps 67 is not limited to two; alternatively, the first heat-insulating members 60*a* and 60*b* and the second heat-insulating member can be connected by one dent 63 and one bump 67 by increasing the widths of the dent 63 and the bump 67. Or, it is also possible to provide three or more dents 63 and three or more bumps 67.

As shown in FIG. 10, the first heat-absorbing member 70 is fasted to the first heat-insulating member 60*a* by thread fastening. As a variation, instead of thread fastening, a dent can be formed on the first heat-absorbing member 70, and a bump to be fitted in the dent can be formed on the first heat-insulating member 60*a*, so that the first heat-absorbing member 70 and the first heat-insulating member 60*a* can be fasted to each other by the dent and the bump. This makes no screw required in assembling of the nip forming member.

The fixing device according to an embodiment can fasten the sliding sheet to the heat-uniformizing member with a simple configuration without impairing the fixing performance, durability, and conveying performance.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

a rotatable endless belt type fixing member;

a pressurizing member that is opposed to the fixing member and rotates; and a nip forming member that is arranged inside the fixing member, and forms a nip part by contact with the pressurizing member through the fixing member, wherein the nip forming member includes:

a heat-uniformizing member having bent portions opposed to each other;

a heat-insulating member arranged inside the heat-uniformizing member;

a heat-absorbing member arranged on an upper surface of the heat-insulating member; and a sliding sheet that covers a nip side of the heat-uniformizing member, and is held between the bent portions of the heat-uniformizing member and the heat-insulating member, and the heat-uniformizing member and the heat-insulating member are fastened to each other by fitting a fitting part formed on the heat-uniformizing member to a fitted part formed on the heat-insulating member.

2. The fixing device according to claim 1, wherein the heat-insulating member includes a first heat-insulating member on which a dent is formed and a second heat-insulating member on which a bump is formed, and the first heat-insulating member and the second heat-insulating member are connected by fitting the dent to the bump.

3. The fixing device according to claim 1, wherein the heat-absorbing member is fastened to the heat-insulating member fitted to the heat-uniformizing member by a fastening member.

4. An image forming apparatus comprising the fixing device according to claim 1.

* * * * *